United States Patent [19]

Henle et al.

[11] 4,287,703

[45] Sep. 8, 1981

[54] METHOD AND APPARATUS FOR FILLING AND SEALING CONTAINERS

[75] Inventors: Karl Henle, Reinbek; Nils von Wichert, Glinde, both of Fed. Rep. of Germany

[73] Assignee: Hauni-Werke Körber & Co. KG, Hamburg, Fed. Rep. of Germany

[21] Appl. No.: 96,422

[22] Filed: Nov. 21, 1979

[30] Foreign Application Priority Data

Nov. 27, 1978 [DE] Fed. Rep. of Germany ..... 2851202

[51] Int. Cl.[3] ..... B65B 3/02; B31B 7/74

[52] U.S. Cl. ..... 53/449; 53/175; 53/284; 493/100; 493/907

[58] Field of Search ..... 53/449, 175, 282, 284; 93/36.01, 54.2; 493/100, 93, 95–99, 907

[56] References Cited

U.S. PATENT DOCUMENTS

| | | | |
|---|---|---|---|
| 2,514,867 | 7/1950 | Howard et al. | 53/175 X |
| 3,306,001 | 2/1967 | Peppler | 53/449 |
| 3,774,509 | 11/1973 | Heinzer | 53/175 X |
| 3,983,682 | 10/1976 | Scully | 53/525 |

FOREIGN PATENT DOCUMENTS

| | | | |
|---|---|---|---|
| 1433959 | 2/1966 | France | 53/449 |

*Primary Examiner*—James F. Coan
*Attorney, Agent, or Firm*—Peter K. Kontler

[57] ABSTRACT

Boxes which are open at the top and partly open at the bottom are transported by a chain conveyor past assembling, filling and sealing stations. At the assembling station, each box receives a bag which is open at the top and closed at the bottom, and each box further receives a platform which is inserted through its partially open bottom and extends to such a level as to maintain the open top of the respective bag above the open top of the box. Successive containers consisting of boxes and empty bags are then advanced to the filling station where the bags receive metered quantities of pulverulent, granular or other material, and the thus filled containers are advanced to the sealing station where the tops of the filled bags are readily sealable because they project upwardly beyond the open tops of the corresponding boxes. The boxes are then raised relative to the filled and sealed bags so that the bags are fully received therein before the top and bottom ends of the boxes are closed and the finished containers are removed from the chain conveyor. The platforms are retracted immediately downstream of the sealing station.

19 Claims, 6 Drawing Figures

Fig. 4
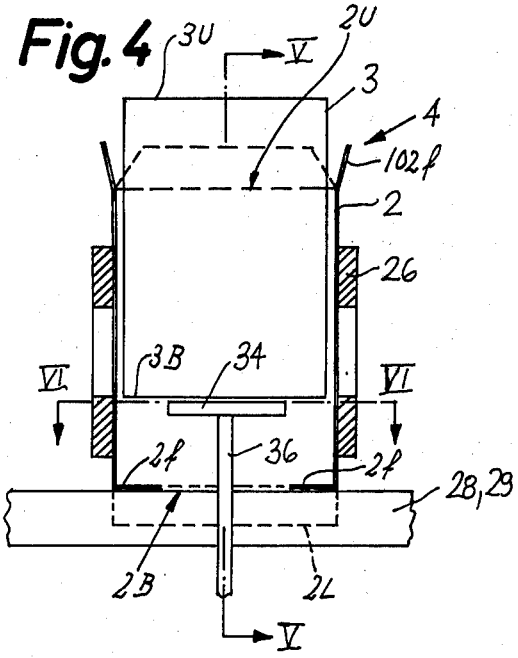
Fig. 5
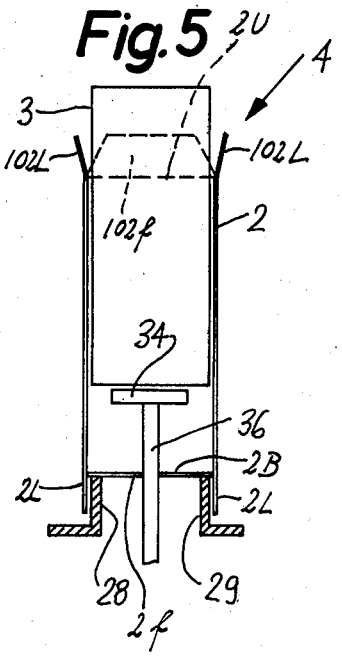
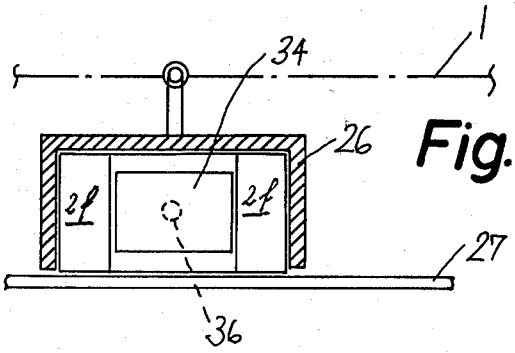
Fig. 6

METHOD AND APPARATUS FOR FILLING AND SEALING CONTAINERS

BACKGROUND OF THE INVENTION

The present invention relates to a method and apparatus for manipulating containers for pulverulent, granular or piece goods. More particularly, the invention relates to a method and apparatus for filling preferably flexible inner envelopes (hereinafter called bags) while the bags are confined in preferably stiff outer envelopes (hereinafter called boxes).

It is already known to introduce flowable materials into containers wherein a collapsible box confines a deformable bag. As a rule, the bags are introduced into successive boxes at a first or assembling station, the resulting empty containers are thereupon transported to a filling station where the bags receive requisite quantities of a flowable material, and the open upper ends of the bags are thereupon sealed prior to complete closing of the boxes. Such procedure is known as the "bag-in-box" technique and has been found to be highly satisfactory for storage of a wide variety of flowable and/or other materials (e.g., biscuits) in bags which are confined or about to be confined in boxes.

Since the bags are normally filled subsequent to insertion into the respective boxes, each bag must be open at its upper end when it arrives at the filling station. The filling station is followed by the sealing station for the open ends of the bags. Such sealing is possible if the open ends of filled bags are accessible to the sealing instrumentalities. In the case of bags which consist of thermoplastic material, the sealing action can be carried out by the application of pressure and/or heat. This means that, if the bottom of a filled bag rests on the bottom of the respective box, the height or length of the bag must appreciably exceed the length or height of the box in order to ensure that the open upper end of a bag at the sealing station can be subjected to the action of electrodes which apply requisite amounts of heat so as to effect a sealing action. Such design of bags is necessary irrespective of the exact nature of sealing instrumentalities, i.e., also if the sealing action is achieved by the simple expedient of rolling a splice or the like.

The situation is aggravated due to the fact that, as a rule, flexible bags which are inserted into cardboard boxes or like outer envelopes are not filled to capacity. In most instances, the bags are filled to approximately 75 percent of their capacity which means that, when the open end of a filled or nearly filled bag extends upwardly beyond the respective box, a substantial quantity of the material of the bag must be cut away in order to ensure that the sealed bag will fit into its box. Alternatively, the upper part of the sealed bag must be subjected to a pronounced deforming action so as to force it into the upper portion of the corresponding box. The additional cost due to waste in the material of the bags is not too serious when the quantities of containers are small. However, the cost of wasted material of which the bags are made is extremely high if the containers are to store certain types of commodities (such as flowable granular or pulverulent foodstuffs) which must be produced in huge quantities. Furthermore, storage of certain commodities necessitates the use of special types of foils or other materials of which the bags are made, and the cost of such materials is sufficiently high to warrant each and every attempt at a reduction of waste in the material of the bags.

OBJECTS AND SUMMARY OF THE INVENTION

An object of the invention is to provide a novel and improved method of assembling and filling containers in accordance with the "bag-in-box" technique in such a way that waste in the material of the constituents of containers (especially in the material of the bags) is reduced to a minimum.

Another object of the invention is to provide a method which allows for the mass-assembly, filling and sealing of containers regardless of the fact that the dimensions of the bags are smaller than in accordance with heretofore known techniques.

A further object of the invention is to provide a method which can be practiced by resorting to simple and compact apparatus.

An additional object of the invention is to provide a method of introducing flowable materials into bags which are partially confined in boxes or like outer envelopes.

Another object of the invention is to provide an apparatus for the practice of the above outlined method and to equip the apparatus with novel and improved means for achieving substantial savings in the material of bags.

A further object of the invention is to provide the apparatus with novel and improved means for transporting and otherwise manipulating boxes and bags as well as empty and filled containers which are composed of boxes and bags.

An additional object of the invention is to provide the apparatus with novel and improved means for maintaining the boxes and the respective bags in predetermined positions in relation to each other.

One feature of the invention resides in the provision of a method of introducing a flowable (granular, pulverulent or larger particulate) material into and for sealing such material in the deformable bags of containers, each of which further includes a box (e.g., a collapsible cardboard box) for the respective bag. The method comprises the steps of introducing boxes which are open at two opposite ends thereof (preferably at the top and at the bottom) into a first portion of a predetermined conveyance path which is preferably an endless path, inserting empty bags (each of which has an open end and a closed end and the closed end is preferably located at the bottom of the respective bag) into successive boxes in a second portion of the path so that the closed end of the bag enters by way of one open end (preferably by way of the upper end) and the open end of the bag is thereupon accessible at the outside of the one open end of the respective box, introducing flowable material through the open ends of and into successive bags in a third portion of the path, maintaining the open ends of successive bags outside of the respective boxes, at least in a fourth portion of the path, sealing the open ends of successive bags in the fourth portion of the path, and thereupon effecting a relative movement between successive bags and the associated boxes so as to introduce the sealed ends of successive bags into the respective boxes.

The length of each box, as considered from the one to the other open end thereof, preferably at least approximates the distance between the open and closed ends of an unsealed bag so that the extent to which the open end of a bag projects beyond the one open end of the corresponding box at least approximates the distance between the other open end of a box and the closed end of the corresponding bag in the fourth portion of the path. The maintaining step preferably includes arresting the bags during insertion of bags in such positions that the closed end of each bag is located at a fixed distance from the other open end of the respective box.

The boxes are preferably transported along the aforementioned path in such orientation that the one open end of each box is located at a level above the other open end so that the open ends of the bags extend upwardly beyond the respective boxes in the fourth portion of the path.

In accordance with a presently preferred embodiment of the invention, the maintaining step comprises holding the open ends of successive bags outside of the respective boxes in the second, third and fourth portions of the path. The moving step preferably includes shifting successive boxes relative to the respective bags, and such shifting step preferably includes moving the other end of each box into contact with the closed end of the respective bag. As a rule, the sealed ends of bags in the fourth portion of the path extend upwardly and beyond the respective boxes. The shifting step then includes lifting the boxes with respect to the associated bags.

In accordance with a presently preferred embodiment of the maintaining step, the latter includes inserting an obstruction (such as a platform) via the other end of and into each box in the second portion of the path so that the obstructions prevent further penetration of closed ends of successive bags into the respective boxes.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is an enlarged vertical sectional view as seen in the direction of arrows from the line IV—IV of FIG. 2;

FIG. 5 is a vertical sectional view as seen in the direction of arrows from the line V—V of FIG. 4; and FIG. 6 is a horizontal sectional view as seen in the direction of arrows from the line VI—VI of FIG. 4.

DESCRIPTION OF THE PREFERRED EMBODIMENTS

Figure 1:
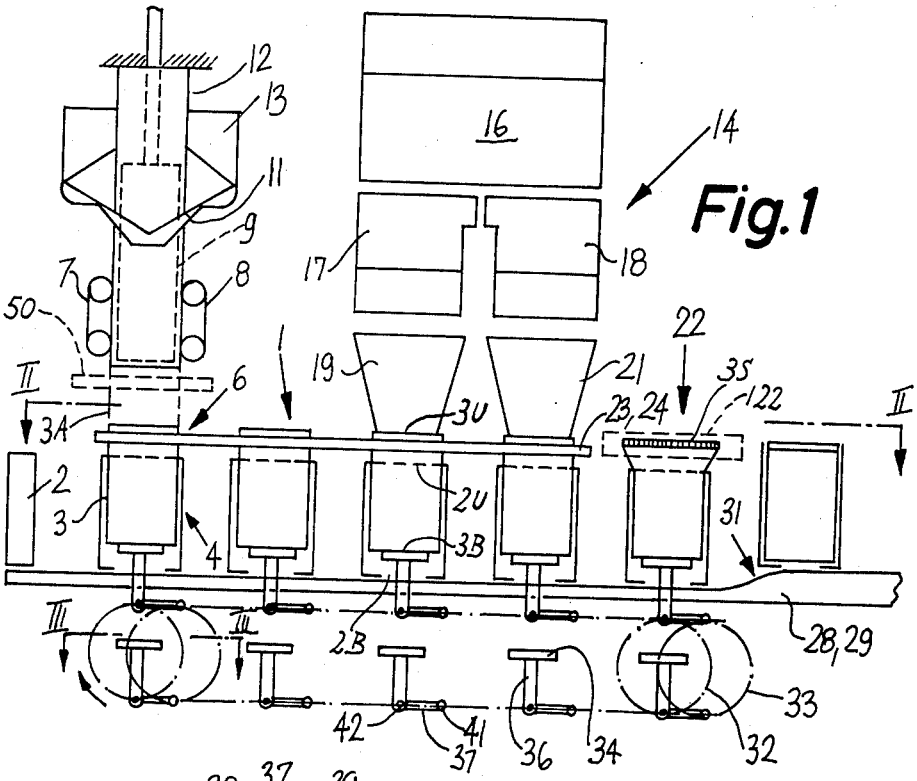
FIG. 1 is a schematic elevational view of an apparatus which embodies the invention.
Figure 3:
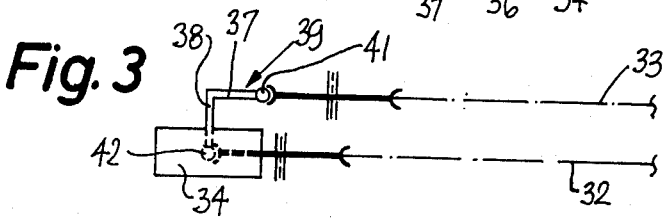
FIG. 3 is a schematic horizontal sectional view as seen in the direction of arrows from the line III—III of FIG. 1.

The apparatus of FIG. 1 comprises a transporting unit which includes an endless chain conveyor 1 serving to transport the components of containers 4. Such components include foldable or collapsible cardboard boxes 2 and bags 3 which are inserted into the boxes prior to filling with a flowable material.

The bags 3 are formed at a level above an assembling or inserting station 6 adjacent to a first portion of an endless path which is defined by the chain conveyor 1. As shown in the upper left-hand portion of FIG. 1, the means for forming successive bags 3 comprises a hollow mandrel 12 and a shaping member 11. A sheet 13 of metallic or plastic foil is fed by suitable conveyor means, not shown, into the range of the shaping member 11. Such sheet is draped around the hollow mandrel 12 to be converted into a tube 3A which is advanced downwardly, as viewed in FIG. 1, by a plunger 9 which is reciprocable in and downwardly beyond the mandrel 12. Conveyors 7 and 8 (preferably endless belt conveyors) cooperate with the plunger 9 to transport successive lengths of the tube 3A downwardly toward the assembling station 6. A suitable sealing device, not shown, seals the lower end of the tube 3A prior to introduction into a box 2 therebelow. In the illustrated embodiment, the mandrel 12 has a rectangular cross-sectional outline because the apparatus is intended to form containers 4 of similar cross-sectional configuration.

The assembling station 6 is followed by a filling station 14 adjacent to a further portion of the endless path which is defined by the chain conveyor 1. The components at the filling station 14 comprises a weighing device 16 with two metering conveyors 17, 18 which respectively deliver metered quantities of flowable material into two funnels 19 and 21. The filling station 14 is followed by a sealing station 22 at which the readily accessible open upper ends of successive bags 3 are sealed, as at 3S, while such open ends extend upwardly and beyond the open upper ends 2U of the respective boxes 2. The exact details of the sealing device or devices at the station 22 form no part of the present invention. Such devices are well known in the art of making plastic or other bags.

The apparatus of FIG. 1 further comprises two elongated suction applying devices 23, 24 which flank the path of forward movement of upper end portions 3U of successive bags 3. The devices 23, 24 have suction ports which face the adjacent sides of the open upper ends 3U of the bags 3 so as to maintain such upper ends in open positions during transport past the funnels 19 and 21 at which the bags are filled with a flowable pulverulent, granular or larger particulate material. For example, the bags 3 can receive comminuted foodstuffs or similar commodities. Each of the suction applying devices 23, 24 may constitute an elongated hose with a plurality of orifices facing the adjacent sides of successive bags 3.

As shown in FIGS. 1, 2 and 4 to 6, the chain conveyor 1 carries a plurality of discrete holders 26 for boxes 2. Each holder 26 has a substantially U-shaped configuration so that it can engage three different sides of a box 2. In order to prevent escape of boxes 2 from the respective holders 26, the apparatus further comprises a barrier 27 (see FIG. 6) which is an elongated strip or bar extending along the open sides of successive holders 26. Each box 2 which is inserted into a holder 26 in the region of the left-hand sprocket wheel 43 for the chain conveyor 1 (as viewed in FIG. 2) is open at the top (2U) and is at least partially open at the bottom (2B), i.e., both ends of the box are open so that a bag 3 (whose lower end 3B is closed) can be inserted from above and that a supporting device in the form of a horizontal platform 34 can be introduced into each box 2 from below while such box advances toward the filling station 14 and thereupon toward and beyond the sealing station 22. In fact, a partition 34 can be introduced into a box 2 from below at a time when such box reaches the assembling station 6. The holders 26 on the chain conveyor 1 are equally spaced from each other and are advanced stepwise in a counterclockwise direction, as viewed in FIG. 2.

Figure 2:
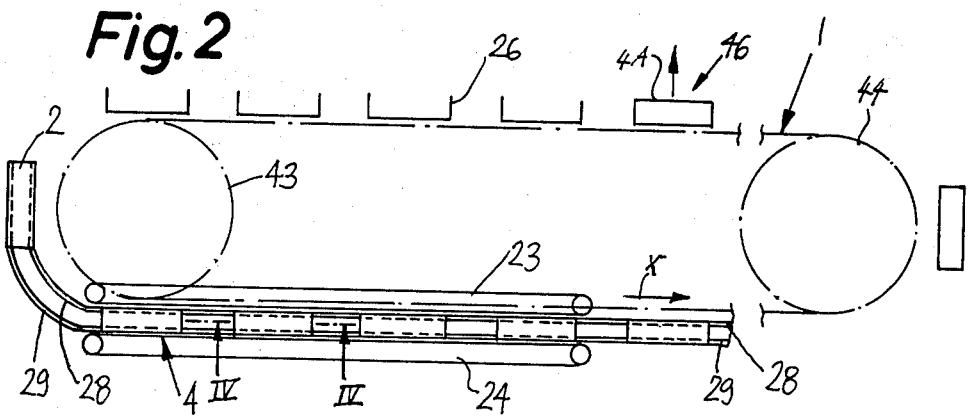
FIG. 2 is a schematic horizontal sectional view as seen in the direction of arrows from the line II—II of FIG. 1.

In order to prevent the boxes 2 from slipping downwardly and out of the respective holders 26, the transporting unit including the chain conveyor 1 further comprises two elongated guide rails 28 and 29, which are best shown in FIGS. 2, 4 and 5. These guide rails extend from below into the path of movement of boxes 2 from the station 6 to the station 14 and thereupon to the station 22. As shown in FIG. 5, the guide rails 28, 29 have a substantially L-shaped cross-sectional outline and their upwardly extending legs engage the inwardly bent smaller flaps 2f at the lower ends 2B of successive boxes 2. The larger or longer flaps 2L are outwardly adjacent to the upwardly extending legs of the respective guide rails 28, 29. The boxes 2 which are inserted into successive holders 26 and the station which is located to the left of the sprocket wheel 43 of FIG. 2 descend onto the guide rails 28, 29 and slide therealong in stepwise fashion toward and beyond the sealing station 22.

FIG. 1 shows that the right-hand portions of the rails 28, 29 slope upwardly, as at 31, to define two cam tracks or ramps (only one shown) constituting lifting means along which successive boxes 2 slide to move to a higher level whereby the sealed and filled bags 3 penetrate deeper into the respective boxes prior to folding of the flaps 102*f*, 102L at the upper ends 2U of such boxes in order to complete the conversion of boxes and filled and sealed bags into filled and closed containers 4A. The closing of the lower and upper ends of successive boxes 2 is completed not later than when such boxes reach a removing station 46 which is shown in FIG. 2 and at which the containers 4A are removed from the respective holders 26. The empty holders 26 thereupon advance along the upper reach of the chain conveyor 1, as viewed in FIG. 2, toward the station where they receive fresh empty boxes 2.

A further transporting unit including two endless chain conveyors 32 and 33 is disposed at a level below the chain conveyor 1. The conveyors 32 and 33 are slightly offset with respect to each other, as considered in the longitudinal direction of the guide rails 28, 29. These conveyors support a set of equally spaced platforms 34 in such positions that the top surfaces of the platforms remain horizontal, regardless of whether the platforms move upwardly in the region of the station 6, along the horizontal stretches of the conveyors 32, 33 or downwardly in the region which is located downstream of the sealing station 22. The carrier means for each support or platform 34 comprises an upright rod 36 the upper end of which is rigid with the respective platform 34, and an L-shaped lever 39 with legs 37, 38 which are rigidly connected to each other. The leg 38 carries the rod 36. The free ends of the legs 37, 38 are respectively connected to the chain conveyors 33, 32 by universal joints 41, 42. The just described mounting for the platforms 34 insures that their top surfaces remain horizontal and that each of these platforms has a vertical component of movement at each end of the path which is defined by the chain conveyors 32, 33, i.e., that successive platforms 34 can penetrate from below through the partially open lower ends 2B of successive boxes 2 at the station 6 and that successive platforms 34 can be withdrawn downwardly through and below the partially open ends 2B of the respective boxes 2 at a location downstream of the station 22. This enables the boxes 2 to rise relative to the corresponding bags 3 (which are already filled and sealed) during travel of the boxes along the lifting means including the cam tracks 31 of the guide rails 28 and 29.

The operation:

Empty boxes 2 are fed into successive holders 26 in a foremost portion of the elongated path which is defined by the chain conveyor 1. Such boxes are open at the top (2U) and at the bottom (2B) and are introduced into consecutive holders 26 in the region of the sprocket wheel 43. The shaft of the sprocket wheel 43 or 44 is driven in stepwise fashion so that the chain conveyor 1 advances in the direction which is indicated by the arrow X. Successive empty boxes 2 advance to the assembling station 6, i.e., into that portion of the path defined by the chain conveyor 1 which is located below the station for the making of successive empty bags 3. Each bag 3 is closed at the lower end 3B and open at the upper end 3U. Such bags are formed by drawing a sheet 13 of metallic or plastic foil downwardly and over the shaping member 11 and around the mandrel 12. The resulting tube 3A is transported downwardly by the endless belt or band conveyors 7, 8 and plunger 9 so that successive increments of the tube 3A advance beyond the lower end of the mandrel 12. The tube 3A is already closed at the lower end, and such lower end is inserted into the box 2 therebelow in such a way that it is located at a predetermined level above the open lower end 2B of the respective box 2. This is due to the presence of a platform 34 in the interior of the box 2 at the assembling station 6.

The plunger 9 is thereupon retracted to its upper end position, and a severing device 50 (indicated by a broken line) severs the tube 3A at a level above the open upper end 2U of the box 2 at the station 6 so as to form a bag 3. At the same time, the lower end of the remainder of the tube 3A is sealed so as to form the closed lower end of the next bag which is to be introduced into the next-following empty box 2 upon arrival at the station 6.

Platforms 34 are introduced into successive boxes 2 arriving at the assembling station 6 prior to introduction of bags 3 into such boxes. The insertion of platforms 34 is possible because the lower ends 2B of the boxes 2 arriving at the station 6 are partially open due to the fact that only the two shorter bottom flaps 2*f* of each box 2 are folded to horizontal or closed positions at the time the respective boxes move into register with the plunger 9. This is shown in FIGS. 4 and 6 which further show that the longer bottom flaps 2L of such boxes are located in two parallel vertical planes and are outwardly adjacent to the upstanding legs of the respective guide rails 28 and 29. Thus, the platforms 34 can readily enter the boxes 2 from below, and their length (as considered at right angles to the plane of FIG. 5) is sufficient to provide an adequate support for the closed lower ends 3B of the descending bags 3 (actually for the closed lower end of the tube 3A which is formed by the parts 11 and 12 at the station 6).

The length of each bag 3 preferably equals or approximates the length of a box 2 (as measured vertically in FIG. 4 or 5). In other words, when a platform 34 enters a box 2 at the station 6, the distance between the open upper end 3U of a freshly inserted bag 3 and the open upper end 2U of the respective box 2 at the station 6 is the same as the distance between the top surface of an inserted platform 34 and the open lower end 2B of the respective box 2.

The chain conveyor 1 thereupon advances its holders 26 by a step whereby a box 2 with a freshly inserted bag 3 therein reaches the filling station 14. The chain conveyors 32, 33 are driven in synchronism with the chain conveyor 1 so that, once inserted from below, a platform 34 remains in the interior of the corresponding box 2 and prevents any or any appreciable downward movement of the respective bag 3, i.e., the open upper end 3U of such bag is accessible at a level above the open upper end 2U of the corresponding box 2. The suction applying devices 23 and 24 maintain the upper end portions 3U of bags 3 arriving at the station 14 in open positions by attracting the respective portions of the open upper end 3U of each bag to thus ensure that the flowable material which is admitted at the station 14 can enter, without obstruction, into the respective bags 3 and to fill the bags to the desired degree. The devices at the filling station 14 admit into each bag 3 a metered quantity of flowable material. Such admission can take place in two stages, or two bags 3 can be filled in a simultaneous operation. Also, each bag 3 can receive two different types of flowable material. All that counts is to ensure that each bag 3 which advances beyond the station 14 (when the conveyors 1, 32 and 33 are again set in motion) is filled (to the desired level) with one or more types of flowable material.

When the conveyors 1, 32 and 33 are set in motion again, they advance the foremost filled (but still open) container 4 and the corresponding platform 34 to the sealing station 22 where the open upper end 3U of the bag 3 (which is already filled) is sealed by the application of heat and/or pressure. The sealing action of the sealing means 122 (indicated by broken lines) is simple and convenient because the open upper end 3U of the filled bag 3 extends upwardly and above the open upper end 2U of the respective box 2. Thus, the electrodes and/or other components of the sealing means 122 which occupies the station 22 can be applied to the bag 3 without any interference on the part of the corresponding box 2.

The foremost filled container 4 is then advanced by a step whereby the chain conveyors 32, 33 cause the corresponding platform 34 to descend so that it is withdrawn from the respective box 2. This enables the filled and sealed bag 3 to descend by gravity so that its sealed upper end 3S enters the interior of the associated box 2. However, and in order to ensure that friction between the components 2 and 3 will not prevent full introduction of the filled and sealed bag 3 into the associated box 2, the apparatus which is shown in the drawing preferably effects such relative movement between a bag and the corresponding box that the box moves upwardly relative to the filled and sealed bag. This is achieved by the lifting means 31 of the guide rails 28, 29 which raises the oncoming box 2 relative to the filled and sealed bag 3 therein. If desired, a top plate or the like can be provided at a level above the lifting means 31 to prevent the bags 3 from rising with the rising boxes 2, i.e., such plate can serve as an abutment for the sealed upper ends 3S of filled bags 3 to guarantee that such upper ends are invariably confined in the corresponding boxes 2 when the boxes reach the right-hand end of and advance beyond the lifting means 31. The end result is that the closed bottom end 3B of each filled and sealed bag 3 is closely adjacent to and preferably abuts against and rests on the lower end 2B of the associated box 2. The box 2 is thereupon closed by folding of its lower flaps 2L as well as by folding of all of its upper flaps **102*f*, 102L. The thus obtained filled and closed containers 4A are removed from the respective holders 26 at the station 46 (see FIG. 2) downstream of the sprocket wheel 44 and the empty holders 26 are advanced toward the left-hand end turn of the chain conveyor 1 (i.e., into the region of the sprocket wheel 43) to receive fresh empty boxes 2 each of which is open at the top (2U) and each of which is sufficiently open at the bottom (2B) to allow for introduction of a platform 34 at the station 6**.

It is clear that the platforms 34 can be introduced into the boxes 2 thereabove at a station other than the assembling station. For example, such platforms can be introduced ahead of the filling station 14 but downstream of the station 6, as long as they ensure that the open upper ends 3U of the bags 3 are accessible not later than at the sealing station 22. However, it is preferred to introduce the platforms 34 not later than at the station 14 so as to enable the suction applying devices 23, 24 to attract the respective sides of the open upper ends 3U of bags 3 during introduction of metered quantities of flowable material into their interior.

An important advantage of the improved method and apparatus is that the quantity of material which is used for the making of bags 3 is a relatively small fraction of quantities which are needed to make bags for use in heretofore known apparatus whose operation is based on the "bag-in-box" technique. This is due to the fact that the platforms 34 invariably ensure full accessibility of the upper ends 3U of bags 3 at the station 22 so that such upper ends can be readily treated by the sealing means 122. As mentioned above, the distance between the lower end 2B of a box 2 and the closed lower end 3B of a bag 3 which is partially received therein (due to the presence of a platform 34 in the interior of such box) may equal the distance between the open upper end 3U of the bag and the open upper end 2U of the corresponding box. Thus, by the simple expedient of selecting the extent of penetration of platforms 34 into the boxes 2 thereabove while the boxes travel toward and are located at the sealing station 22, one can determine, in advance, the extent to which a bag 3 of given length or height projects upwardly beyond the open upper end 2U of the corresponding box. Moreover, and since the upper parts of bags 3 can extend well above the upper ends 2U of the associated boxes 2, the bags 3 can be filled practically to capacity rather than to approximately 75 percent of their capacity as is customary in heretofore known apparatus. It has been found that judicious selection of the extent to which the platforms 34 penetrate into the boxes 2 thereabove will (a) simplify the filling and sealing operations, (b) entail a considerable reduction of the quantity of material which is needed to make the bags 3, and (c) reduce the number of improperly assembled containers 4A. Moreover, the output of the apparatus can be increased because the sealing means 122 can readily reach the upper ends 3U of filled bags 3 arriving at the station 22.

The mounting of platforms 34 on endless conveyor means (such as the conveyor means including the two chain conveyors 32, 33) also contributes to simplicity and reliability of the apparatus. Thus, the path along which the platforms 34 move can be selected in advance with a high degree of reproducibility so that each and every container 4 is manipulated in a predetermined way because the extent to which consecutive bags 3 project upwardly and beyond the associated bags 2 is always the same.

It is also within the purview of the invention to omit the lifting means 31 and to rely on the weight of filled and sealed bags 3 for descent of the bottom ends 3B into contact with the closed flaps 2*f* and 2L of the respective boxes 2. The construction which is shown in the drawing (i.e., raising of the boxes 2 relative to the corresponding filled and sealed bags 3 through the medium of the lifting means 31 or in an analogous manner while the level of the filled and sealed bags 3 preferably remains unchanged) is preferred at this time because it is more reliable. As mentioned above, the apparatus which is shown in the drawing is not influenced by fluctuations of friction between the internal surfaces of boxes 2 and the external surfaces of the respective filled and sealed bags 3 because the introduction of the upper parts of bags into the respective boxes in a region between the sealing station 22 and the removing station 46 is not dependent on gravity.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. A method of introducing a flowable material into and of sealing such material in the bags of containers which further include boxes for the bags, comprising the steps of introducing boxes which are open at two opposite ends thereof into a first portion of a predetermined conveyance path wherein the boxes advance in a predetermined direction; inserting empty bags, each of which has an open end and a closed end, into successive boxes in a second portion of said path downstream of said first portion, as considered in said direction, so that the closed end of the bag enters into and the open end of the bag is accessible via one open end of the respective box; introducing flowable material through the open ends of and into successive bags in a third portion of said path; maintaining the open ends of successive filled bags outside of the respective boxes, at least in a fourth portion of said path downstream of said second portion; sealing the open ends of successive bags in said fourth portion of said path; and thereupon effecting relative movement between successive filled bags and the associated boxes so as to introduce the sealed ends of successive filled bags into the respective boxes.

2. The method of claim 1, wherein the length of each box, as considered from the one toward the other open end thereof, at least approximates the distance between the open and closed ends of a bag so that the extent to which the open end of a bag projects beyond the one open end of the corresponding box at least approximates the distance between the other open end of a box and the closed end of the corresponding bag in said fourth portion of said path.

3. The method of claim 1, wherein said maintaining step includes arresting the bags during insertion thereof in such positions that the closed end of each bag is located at predetermined distances from the open ends of the respective box.

4. The method of claim 1, wherein the boxes are transported along said path in such orientation that the one open end of each box is located at a level above the other open end so that the open ends of bags extend upwardly beyond the respective boxes in said fourth portion of said path.

5. The method of claim 1, wherein said maintaining step includes inserting an obstruction via the other end of and into each box in said second portion of said path so that the obstructions prevent further penetration of closed ends of successive bags into the respective boxes.

6. A method of introducing a flowable material into and of sealing such material in the bags of containers which further include boxes for the bags, comprising the steps of introducing boxes which are open at two opposite ends thereof into a first portion of a predetermined conveyance path; inserting empty bags, each of which has an open end and a closed end, into successive boxes in a second portion of said path so that the closed end of the bag enters into and the open end of the bag is accessible via one open end of the respective box; introducing flowable material through the open ends of and into successive bags in third portion of said path; maintaining the open ends of successive bags outside of the respective boxes, at least in a fourth portion of said path; sealing the open ends of successive bags in said fourth portion of said path; and thereupon effecting relative movement between successive bags and the associated boxes so as to introduce the sealed ends of successive bags into the respective boxes, including shifting successive boxes relative to the respective bags.

7. The method of claim 6, wherein said shifting step includes moving the other end of each box into contact with the closed end of the respective bag.

8. The method of claim 6, wherein the sealed ends of the bags in said fourth portion of said path extend upwardly and beyond the respective boxes and said shifting step includes lifting the boxes with respect to the associated bags.

9. A method of introducing a flowable material into and of sealing such material in the bags of containers which further include boxes for the bags, comprising the steps of introducing boxes which are open at two opposite ends thereof into a first portion of a predetermined conveyance path; inserting empty bags, each of which has an open end and a closed end, into successive boxes in a second portion of said path so that the closed end of the bag enters into and the open end of the bag is accessible via one open end of the respective box; introducing flowable material through the open ends of and into successive bags in a third portion of said path; maintaining the open ends of successive bags outside of the respective boxes in said second and third portions and a fourth portion of said path; sealing the open ends of successive bags in said fourth portion of said path; and thereupon effecting relative movement between successive bags and the associated boxes so as to introduce the sealed ends of successive bags into the respective boxes.

10. Apparatus for introducing a flowable material into and for sealing such material in bags of containers which further include boxes for the bags, comprising means for transporting boxes which are open at the top and bottom in a predetermined direction and along an elongated path; means for inserting empty bags, each of which is open at its upper end and closed at its lower end, through the open tops of and into successive boxes in a first portion of said path; means for admitting flowable material through the open upper ends of and into the interior of successive bags in a second portion of said path; means for sealing the open upper ends of filled bags in a third portion of said path downstream of said first portion, as considered in said direction; and means for effecting a relative movement between the boxes and the respective bags in a fourth portion of said path downstream of said third portion so that each filled and sealed bag is fully confined in the corresponding box.

11. Apparatus for introducing a flowable material into and for sealing such material in bags of containers which further include boxes for the bags, comprising means for transporting boxes which are open at the top and bottom along an elongated path; means for inserting empty bags, each of which is open at its upper end and closed at its lower end, through the open tops of and into successive boxes in a first portion of said path; means for admitting flowable material through the open upper ends of and into the interior of successive bags in a second portion of said path; means for sealing the open upper ends of bags in a third portion of said path; support means for maintaining the open ends of bags at a level above the tops of the respective boxes in said third portion of said path, including platforms and conveyor means for introducing platforms from below into successive boxes ahead of said third portion and for withdrawing the platforms from successive boxes downstream of said third portion, as considered in the direction of transport of boxes along said path; and means for effecting a relative movement between the boxes and the respective bags in a fourth portion of said path so that each filled and sealed bag is fully confined in the corresponding box.

12. The apparatus of claim 11, wherein the distance between the top and bottom of a box at least approximates the distance between the ends of a bag so that the extent to which the upper end of a bag projects above the top of the corresponding box in said third portion of said path equals the distance between the closed lower end of a bag and the bottom of the corresponding box while the interior of such box receives a platform.

13. The apparatus of claim 11, wherein said conveyor means includes means for moving successive platforms substantially vertically upwardly ahead of said third portion and substantially vertically downwardly downstream of said third portion of said path.

14. The apparatus of claim 13, wherein said conveyor means includes means for moving said platforms vertically upwardly at a level below said first portion of said path.

15. The apparatus of claim 13, wherein said conveyor means comprises two endless conveyors which are offset relative to each other and means for attaching said platforms to each of said endless conveyors.

16. The apparatus of claim 15, wherein said attaching means includes means for maintaining said platforms in horizontal planes.

17. Apparatus for introducing a flowable material into and for sealing such material in bags of containers which further include boxes for the bags, comprising means for transporting boxes which are open at the top and bottom along an elongated path; means for inserting empty bags, each of which is open at its upper end and closed at its lower end, through the open tops of and into successive boxes in a first portion of said path; means for admitting flowable material through the open upper ends of and into the interior of successive bags in a second portion of said path; means for sealing the open upper ends of bags in a third portion of said path; support means for maintaining the open ends of bags at a level above the tops of the respective boxes in said third portion of said path; and means for effecting a relative movement between the boxes and the respective bags in a fourth portion of said path so that each filled and sealed bag is fully confined in the corresponding box, including means for lifting successive boxes relative to the corresponding bags downstream of said third portion of said path.

18. The apparatus of claim 17, wherein said lifting means includes a ramp.

19. The apparatus of claim 18, wherein said transporting means includes at least one guide rail for the bottom of the boxes in said path and said ramp forms part of said rail.

* * * * *